US009987642B2

(12) United States Patent
Alitalo et al.

(10) Patent No.: US 9,987,642 B2
(45) Date of Patent: Jun. 5, 2018

(54) APPARATUS AND METHOD FOR PRODUCING AEROSOL AND A FOCUSING PART

(71) Applicant: Beneq Oy, Espoo (FI)

(72) Inventors: Ville Alitalo, Espoo (FI); Kai Asikkala, Espoo (FI); Simo Tammela, Espoo (FI); Sauli Virtanen, Espoo (FI)

(73) Assignee: BENEQ OY, Espoo (FI)

( * ) Notice: Subject to any disclaimer, the term of this patent is extended or adjusted under 35 U.S.C. 154(b) by 4 days.

(21) Appl. No.: 14/915,663

(22) PCT Filed: Sep. 9, 2014

(86) PCT No.: PCT/FI2014/050686
§ 371 (c)(1),
(2) Date: Mar. 1, 2016

(87) PCT Pub. No.: WO2015/033027
PCT Pub. Date: Mar. 12, 2015

(65) Prior Publication Data

US 2016/0221011 A1 Aug. 4, 2016

(30) Foreign Application Priority Data

Sep. 9, 2013 (FI) ..... 20135903

(51) Int. Cl.
*B05B 7/08* (2006.01)
*B05D 1/02* (2006.01)
(Continued)

(52) U.S. Cl.
CPC ..... *B05B 7/0846* (2013.01); *B05B 1/26* (2013.01); *B05D 1/02* (2013.01); *B05D 1/34* (2013.01); *B05D 3/042* (2013.01)

(58) Field of Classification Search
None
See application file for complete search history.

(56) References Cited

U.S. PATENT DOCUMENTS 2,410,215 A * 10/1946 Houghton ..... B05B 1/26 239/515
2,943,001 A 6/1960 Socke
(Continued)

FOREIGN PATENT DOCUMENTS

EP 2620225 A1 7/2013
FR 1200924 A 12/1959
(Continued)

OTHER PUBLICATIONS

Finnish Office Action for Finnish Application No. 20135903 dated Jan. 27, 2015 (3 pages).
(Continued)

*Primary Examiner* — Shamim Ahmed
*Assistant Examiner* — Bradford M Gates
(74) *Attorney, Agent, or Firm* — Eversheds Sutherland (US) LLP

(57) ABSTRACT

The present invention relates to an apparatus and method for producing aerosol. The apparatus comprising a first atomizer for producing a first aerosol jet and a second atomizer for producing a second aerosol jet, each atomizer comprising an atomizing head in which the liquid is atomized into an atomized aerosol jet. Said atomizers further comprise a focusing part arranged to restrain the atomized aerosol jet for providing a punctual aerosol jet, said focusing part extending directly from the atomizing head. The first and second atomizer form an atomizer pair such that the atomizers are aligned towards each other for colliding the aerosol jets to each other.

16 Claims, 3 Drawing Sheets

(51) Int. Cl.

| | |
|---|---|
| ***B05D 1/34*** | (2006.01) |
| ***B05B 1/26*** | (2006.01) |
| *B05D 3/04* | (2006.01) |

(56) References Cited

U.S. PATENT DOCUMENTS

| | | | | |
|---|---|---|---|---|
| 3,112,072 | A | 11/1963 | Malone | |
| 4,290,384 | A * | 9/1981 | Ausschnitt | G03F 7/167 118/722 |
| 5,497,944 | A | 3/1996 | Weston et al. | |
| 5,967,156 | A * | 10/1999 | Rose | B08B 7/0092 134/7 |
| 6,045,058 | A | 4/2000 | Dobbeling et al. | |
| 6,338,472 | B1 | 1/2002 | Shimazu et al. | |
| 2004/0046130 | A1* | 3/2004 | Rao | C04B 35/565 250/492.1 |
| 2007/0278327 | A1* | 12/2007 | Wolfe | A62C 5/008 239/398 |
| 2010/0258650 | A1* | 10/2010 | Asikkala | B01J 2/04 239/9 |
| 2010/0258652 | A1* | 10/2010 | Ilmarinen | B05B 7/0441 239/311 |

FOREIGN PATENT DOCUMENTS

| | | | |
|---|---|---|---|
| GB | 621785 | | 8/1945 |
| JP | 2000-189856 | A | 7/2000 |
| JP | 2002-126587 | A | 5/2002 |
| JP | 2006-095432 | A | 4/2006 |
| JP | 2010-127603 | A | 6/2010 |
| WO | 2009/080892 | A1 | 7/2009 |
| WO | 2009/080893 | A1 | 7/2009 |
| WO | 2012/120194 | A1 | 9/2012 |

OTHER PUBLICATIONS

PCT International Search Report and Written Opinion for PCT/F12014/050686 dated Dec. 22, 2014 (11 pages).

Supplemental European Search Report for EP Application No. 14 84 2714 dated Jul. 21, 2017 (2 pages).

Chinese Office Action for CN Application No. 2014800495642 dated Apr. 28, 2017 (5 pages).

* cited by examiner

APPARATUS AND METHOD FOR PRODUCING AEROSOL AND A FOCUSING PART

CROSS REFERENCE TO RELATED APPLICATIONS

This application claims the priority benefit of PCT/FI2014/050686 filed on Sep. 9, 2014 and Finnish Application No. 20135903 filed on Sep. 9, 2013. The contents of these applications are hereby incorporated by reference in their entirety.

FIELD OF THE INVENTION

The present invention relates to an apparatus for producing aerosol, and more particularly to what is stated in the preamble of independent claim 1.

The present invention also relates to a method for producing aerosol, and more particularly to what is stated in the preamble of independent claim 12.

The present invention relates also to a focusing part for atomizer, and more particularly to what is stated in the preamble of independent claim 18.

BACKGROUND OF THE INVENTION

In accordance with prior art, liquid can be atomized into small droplets by a plurality of different techniques, such as with a gas-dispersing atomizer, a pressure-dispersing atomizer and an ultrasound atomizer.

It is known in the prior art that two atomizers can be arranged to be oriented substantially directly towards one another in a manner making the aerosol jets produced thereby collide directly into each other. By orienting the aerosol jets preferably substantially directly against each other, aerosol is produced, which has a negligible net momentum due to direct collision. In other words, in prior art collision based atomizers, as the aerosol becomes substantially stationary, it can be moved in the desired direction with a separate gas flow which is oriented substantially to the collision point of the aerosol jets. The aerosol is used for coating a substrate in a deposition chamber.

While the substrate to be coated is usually arranged in the bottom of the deposition chamber, the atomizers are arranged in a horizontal direction such that the separate gas flow is arranged to discharge gas substantially in a vertical direction to direct the aerosol downwards towards the substrate. The atomizers are typically arranged in pairs for constituting one or more atomizer pairs in such a manner that the atomizers of each atomizer pair are oriented substantially directly coaxially towards each other, whereby the aerosol jets of each atomizer pair collide directly into each other. The atomizer pairs are further arranged in the device in succession or adjacently vertically or horizontally. The idea is that the separate gas flow is substantially toward the collision point of the aerosol jets and substantially toward the substrate to be coated such that the aerosol is directed toward the substrate which means that the atomizers are substantially parallel with the substrate to be coated. With the help of the separate gas flow the aerosol can be shaped into a line-like aerosol front for assisting the coating of the substrate.

One of the disadvantages associated with the above arrangement is that the aerosol directed with the help of the separate gas flow may not be uniform when contacting the substrate. The prior art arrangement requires anyway a separate gas nozzle for dispersing the aerosol with the help of gas flow and every additional component increases costs. Aerosol produced with above mentioned atomizers comprise large droplets and large droplets reduce uniformity and evenness in the coating, so a thick liquid film is required which has a high surface tension and requires long time for becoming even on the surface of the substrate. Aerosol sprays that produce aerosol do not produce uniform aerosol and the aerosol beam is not homogeneous. This is compensated by moving either the spray or object to be coated or by moving both which is quite complicated.

BRIEF DESCRIPTION OF THE INVENTION

An object of the present invention is thus to provide a method and an apparatus for implementing the method so as to alleviate the above disadvantages. The object of the invention is achieved with an apparatus according to the independent claim 1. The object of the invention is further achieved with a method according to the independent claim 12 and with the focusing part according to the independent claim 18.

Preferred embodiments of the invention are disclosed in the dependent claims.

In this application the term aerosol means in addition to mere aerosol also fog which is a collection of liquid droplets suspended in the air. The density of fog expressed in resulting decrease in visibility is such that the fog reduces visibility to less than 1 km. Aerosol refers to a suspension of fine liquid droplets in a gas but it also refers in this context to fog referring to a mixture containing liquid particles, but the average size thereof is larger than in aerosol. The liquid droplet may contain some solid particles.

In this application, with aerosol jet it is meant a jet of a mixture of liquid droplets of at least one liquid, and at least one gas.

The apparatus and the method of the present invention are based on the surprising realization of colliding two atomized aerosol jets directly together such that the speed of the aerosol exiting the atomizer is close to the speed of the sound or even over the speed of the sound (supersonic) at the exit point of the atomizer. The static pressure in the collision point is mainly due to the velocity pressure of the aerosol beam. In other words the velocity pressure changes to the static pressure in the collision of the aerosol jets. In this context the velocity pressure is as defined in the publication *Aerosol Technology by William C. Hinds* (*A Wiley-Interscience Publication*). Pressure from the aerosol jet flow causes the aerosol to exit away from the collision point mostly along a plane which is perpendicular to the direction of the aerosol jets. As gas molecules have low inertia, part of the gas molecules travel back close to the aerosol jets in the opposite direction of the aerosol jets, however, causing a slight opposite gas flow close to the surfaces of each of the atomizers. The collision of the aerosol jets also causes a breakup of larger droplets. Some unwanted droplets can also drift on the outer surfaces of the atomizers, causing wetting of the outer atomizer surfaces. Above mentioned opposite gas flows push said unwanted droplets away from the atomizer heads, thus keeping them clean of unwanted wetting and droplets. It has been found that the distance between the atomizers is from 2-5 mm when the breaking of the larger droplets works bests and simultaneously the gas flow keeps the exit faces of the atomizers clean from liquid drops deposited on the atomizers' outer surfaces.

When two atomized aerosol jets are oriented in a manner making them to collide into one another, aerosol is produced, which has smaller drops. In other words, in the collision, larger drops break into smaller ones. Since the aerosol jets are not mixed until at the collision point, said apparatus may be used to produce aerosol comprising at least two different liquids, such as drops atomized from water and methanol, for example, and said liquids may be immiscible with one another, such as water and petrol, for example, or reactive with one another in such a manner that conducting them together to the same atomizer is impossible, for instance because the liquids together form a gelatinous mixture, such as water containing a metal salt and tetramethylorthosilane (TEOS), for example. The apparatus of the invention can be used to produce aerosol also from mixtures, liquids containing a solvent and a metal salt dissolved therein or different liquids for example such that one could be a colloidal solution.

In the method for producing aerosol according to the invention a first atomizer and a second atomizer are arranged opposite to each other such that a discharge opening of the first atomizer is opposite to a discharge opening of the second atomizer. The first and second atomizer comprises an atomizing head for atomizing aerosol jet. At least one liquid precursor is atomized into a first atomized aerosol jet in the first atomizing head and into a second atomized aerosol jet in the second atomizing head. Said atomized aerosol jets are discharged from the discharge openings of the atomizers such that the atomized aerosol jets coming out from the discharge openings are directed substantially directly towards each other preferably in a vertical direction in such a manner that the first and the second atomized aerosol jets collide directly into each other in a collision point. The at least one liquid is brought into the first and the second atomizer in such a pressure that the first and the second atomized aerosol jets when colliding each other in the collision point form aerosol which escapes from the collision point. The aerosol escapes radially and substantially symmetrically from the collision point. The aerosol formed in the collision point is spread after the collision into a perpendicular plane in relation to the direction of the aerosol jets shooting out from the atomizer. When the atomizer pair is positioned into a central region of a deposition chamber with suitable free space around the atomizer pair and the atomizer pair is arranged in a substantially vertical direction, the aerosol plane formed in the collision of the atomized aerosol jets form a substantially horizontal aerosol plane when escaping from the collision point and will spread uniformly on the horizontal direction of the deposition chamber and fill the chamber with a highly uniform aerosol. Further away from the near zone of the atomizer the aerosol density is substantially uniform to all directions. The movement of aerosol settles down due to multiple collisions and is transformed into the heat of the aerosol having net momentum close to zero. Because the evaporation energy of the solvent is high the heating effect is relatively small. Away from the atomizers the main movement of the aerosol toward the substrate to be coated is caused by the gravity and the droplets fall gently on the substrate. The substrate to be coated is preferably arranged on the bottom part of the deposition chamber and arranged preferably parallel to the horizontal or substantially horizontal aerosol plane such that the substrate is coated by said aerosol plane falling under gravity. The substrate and the aerosol are preferably substantially at the same temperature. In an embodiment of the invention the method further comprises a step of restraining the first atomized aerosol jet in a focusing part extending from the atomizing head into a first punctual aerosol jet and the second atomized aerosol jet into a second punctual aerosol jet. In an embodiment of the invention the method further comprises a step of reducing an average drop size of the aerosol jet by arranging a choked flow part to at least one of the atomizers such that before being discharged through the discharge opening the atomized liquid is arranged to go through said choked flow part. In the method according to the invention the atomizers and the substrate to be coated are arranged in the same deposition chamber.

In the apparatus according to the invention a first atomizer is used for producing a first atomized aerosol jet and a second atomizer is used for producing a second atomized aerosol jet. The atomized aerosol jets are produced from one or more liquid precursors and discharged from the atomizer through a discharge opening in the atomizer. Each atomizer comprises an atomizing head in which the liquid is atomized into an atomized aerosol jet. Said atomizers further comprise a focusing part arranged to restrain the atomized aerosol jet for providing a punctual aerosol jet, said focusing part extending directly from the atomizing head. The first and second atomizers form together an atomizer pair such that the atomizers are aligned towards each other for colliding the aerosol jets to each other.

In one embodiment of the invention the focusing part is a choked flow part in which one or more flow restraints are arranged to change the hydrodynamic properties of the aerosol jet being discharged from the atomizing head into the choked flow part in a manner reducing the average drop size of the aerosol jet. One or more flow restraints are arranged in the choked flow part such that they are placed in succession, adjacently or in a corresponding manner with respect to each other.

In the focusing part for atomizer according to the invention said focusing part is arranged to extend directly from the atomizing head and is arranged to restrain the atomized aerosol jet for providing a punctual aerosol jet, said focusing part comprises a discharge opening for discharging the punctual aerosol jet. The focusing part is a substantially tubular, round section after the atomizing head in the direction of the aerosol flow. Purpose of the focusing part is to collimate the aerosol into the collision point so that the energy carried by the aerosol is concentrated into the collision point, causing optimal atomization and breakup of larger droplets. The length of the focusing part is at least 10×, preferably 15× the inner diameter of the focusing part.

In one embodiment of the invention the focusing part is a straight tubular part having a section in which the inner diameter is smaller than the inner diameter in the rest of the tubular part for changing the shape of the aerosol jet into round or roundish.

In another embodiment of the invention the focusing part comprises in the direction of the aerosol flow first a choked flow part in which one or more flow restraints are arranged and then a section in which the shape and the size changes smoothly from the slot type opening of the choked flow part to the round shape of the rest of the focusing part which is called a levelling area. This minimizes the turbulence and the deposition of the material to the surfaces of the atomizing head or focusing part.

The focusing part is preferably such that the atomized aerosol jet coming from the atomizing head is restrained to a punctual aerosol jet so that when two opposing punctual aerosol jets collide to each other in a collision point a punctual collision is achieved. In other words, the focusing part has means for restraining the atomized aerosol jet such that a total opening angle of the punctual aerosol jet is less than 10°. So the punctual collision is achieved when a total opening angle of the aerosol jet discharged from the atomizer is less than 10° and in a preferred embodiment of the invention less than 5°. The total opening angle is the angle that the aerosol jet forms when coming out from the atomizer, i.e. when spreading out from the discharge opening when measured on a plane parallel to the atomizer pair. By the total opening angle it is not meant an angle in respect of the atomizer's longitudinal axis.

In an embodiment of the invention the focusing part may be a choked flow part in which one or more flow restraints are arranged to change the hydrodynamic properties of the atomized aerosol jet being discharged from the atomizing head into the choked flow part in a manner reducing the average drop size of the aerosol jet, the choked flow part extending directly from the atomizing head. The choked flow part comprises a levelling area between the discharge opening and the nearest flow restraint to the discharge opening for levelling the punctual aerosol jet, said levelling area having a length between 10-20 mm. In another embodiment of the invention the levelling area having a length of 10-15× the inner diameter of the focusing part in the levelling area.

Throughout in this application the term levelling area describes a three dimensional volume in the focusing part where the punctual aerosol jet is levelled. The levelling area is a tubular section, a volume, between the discharge opening and the nearest flow restraint. The nearest flow restraint means the nearest to the discharge opening.

An aerosol in which the average diameter of the liquid drops is less than 3 micrometers and preferably less than 1 micrometer can be produced by subjecting an aerosol jet or an aerosol produced with a pneumatic atomizer to flow restraints, provided that the flow rate of the aerosol jet or aerosol is sufficient. This may be implemented for instance by feeding an aerosol produced with a gas-dispersing atomizer into a tube containing a plurality of flow restraints disposed inside the tube, whereby aerosol having a very small drop size can be produced, provided that the drop-gas mixture, i.e. the aerosol, travels at a sufficiently high rate in the tube. The flow restraints are used to change the hydrodynamic properties of the aerosol produced in a manner reducing the average drop size of the aerosol. The mechanism is based both on collision energy and on the pressure variation caused by the flow restraints. In other words, the flow restraints are arranged in such a manner that the droplets of the aerosol discharging from the atomizing head collide with one or more flow restraints and/or with each other for reducing the drop size of the aerosol. In addition or alternatively, the flow restraints are arranged in such a manner that they cause a pressure variation and/or a throttling in the flow of the aerosol discharging from the atomizing head for reducing the drop size of the aerosol. As the result, ultra small droplets are discharged from the nozzle.

Choked flow part is used for producing an aerosol comprising small droplets such that an aerosol jet or an aerosol produced in the atomizing head is subjected to flow restraints. That way an aerosol can be produced wherein the average diameter of the liquid drops is less than 3 micrometers and preferably less than 1 micrometer. The choked flow part is a tube containing a plurality of flow restraints disposed inside the tube. The gas-drop mixture, i.e. the aerosol, coming from the atomizing head has to travel at a sufficiently high rate in the tube so that aerosol having a very small drop size is produced. The flow restraints are used to change the hydrodynamic properties of the aerosol produced in a manner reducing the average drop size of the aerosol. The flow restraints decrease the cross-sectional area of the atomizer in the choked flow part so that there is a throttling orifice through which the aerosol jet flows.

In order to get the aerosol jets to collide each other a first and a second atomizer form an atomizer pair such that the atomizers are aligned against each other. In a preferable embodiment of the invention the atomizers are arranged in a vertical direction such that the aerosol jets discharged from the atomizers are substantially vertically oriented so that when the aerosol jets collide to each other in the collision point the aerosol that is produced because of the collision of the aerosol jets spreads out in a horizontal or in a substantially horizontal plane. The collision of the aerosol jets produce a pressure point from which the planar aerosol zone will spread out and this creates the main aerosol flow but some gas flow will also be directed toward the atomizers which will affect the atomizers such that the atomizers will stay clean. So the pressure flow will also have a non-soiling and non-wetting effect for the atomizing heads.

An advantage of the method and the apparatus of the invention is that the gravity uniforms the density of the aerosol and the more dense section of the aerosol is spread to larger area as it will displace the less dense aerosol by pushing it upwards. A more uniform liquid coating is formed on the surface of the substrate without using moving components and still having good deposition yield and simple construction. An advantage of the invention is also that the discharge openings of the atomizers stay clean because the collision of the aerosol jets and the pressure of it cause the aerosol escape from the collision point away from the atomizers and because of the droplets are heavier than gas there is only a gas flow coming back to the discharge opening of the atomizer which wipe the opening so that it stays clean.

BRIEF DESCRIPTION OF THE DRAWINGS

In the following the invention will be described in greater detail by means of preferred embodiments with reference to the accompanying drawings, in which.

DETAILED DESCRIPTION OF THE INVENTION

Figure 1:
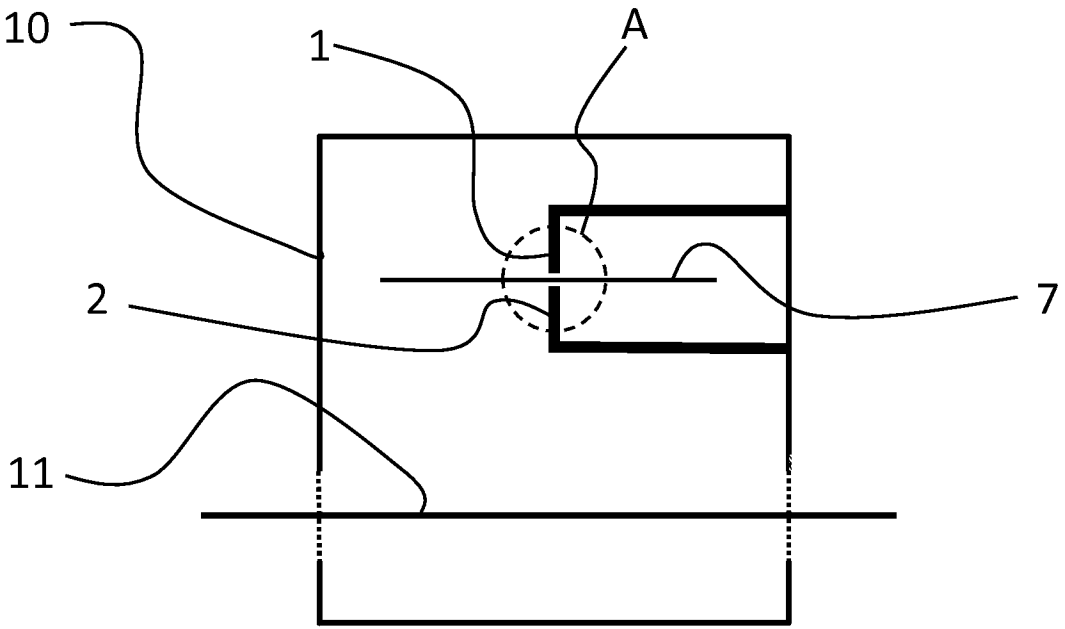
FIG. 1 shows a schematic side view of the apparatus according to the invention, in which two atomizers are oriented substantially directly against each other in a vertical direction.

FIG. 1 shows an apparatus according to the invention for producing aerosol. Side view of the apparatus shows two atomizers 1, 2, which are oriented substantially towards one another and fixed to a body of the apparatus. The first and the second atomizer 1, 2 are preferably arranged substantially coaxially opposite one another in such a manner that aerosol jets 6*a*, 6*b* (shown in FIG. 2) thereof collide substantially directly against each other. The FIG. 1 shows one pair of atomizers 1, 2 but the apparatus may comprise more atomizers as well. The atomizers 1, 2 are preferably arranged in pairs for constituting one or more atomizer pairs in such a manner that the atomizers 1, 2 of each atomizer pair are oriented substantially directly, preferably coaxially, towards each other, whereby the aerosol jets 6*a*, 6*b* of each atomizer pair collide directly into each other. The atomizers 1, 2 are arranged in a deposition chamber 10 such that the atomizer pair is arranged preferably in the central region of said chamber 10. The first and the second atomizer 1, 2 are arranged in a vertical direction such that the discharge openings 8*a*, 8*b* (shown in FIG. 2) of the atomizers 1, 2 are arranged substantially coaxially in a deposition chamber such that the discharge openings are toward each other. So the first atomizer 1 has a discharge opening toward to the bottom of the deposition chamber 10 and the second atomizer 2 has an opening toward the top of the deposition chamber 10. The discharge openings of the first and the second atomizer 1, 2 are close to each other, the distance between the discharge openings in the opposing atomizers 1, 2 is in a range of 0.5-15 mm, and more preferably in a range of 1-10 mm. The most preferable distance between the discharge openings of the opposing atomizers is from 2-5 mm. The closer the discharge openings are to each other the flatter is the aerosol plane escaping from the collision point C (shown in FIG. 2) in which the aerosol jets discharged from the atomizers 1, 2 collide to each other. Respectively the further away the discharge openings are from each other the more fan-like is the aerosol plane. Liquid to be atomized and atomizing gas are fed to the atomizers 1, 2. The liquid is atomized in the atomizing head of the atomizer 1, 2 and aerosol jets are discharged from the first and the second atomizer 1, 2. The aerosol jets 6*a*, 6*b* from opposite atomizers 1, 2 collide with each other, whereby aerosol, composed of very small droplets is produced. In the method of producing aerosol the at least one liquid is brought into the first and the second atomizer 1, 2 in such a pressure that the first and the second aerosol jets 6*a*, 6*b* when colliding each other in the collision point C (in FIG. 2) form aerosol which escapes from the collision point. The aerosol formed in the collision point C (in FIG. 2) escapes from the collision point C (in FIG. 2) such that it forms a plane which is substantially horizontal. The horizontal aerosol spreads out uniformly in the radial direction on a plane which is perpendicular to the direction of the aerosol jets inside the deposition chamber 10. In other words after collision of the opposite aerosol jets 6*a*, 6*b* a disc-like aerosol flux is formed which escapes from the collision point C (in FIG. 2) radially. The aerosol does not therefore have a specific direction but it spreads out radially along a plane near the collision point of the aerosol jets 6*a*, 6*b*. When said atomization is observed visually the aerosol generated in the collision resembles a round thin disc consisting of aerosol and having a centre between the two atomizers. The aerosol is moved toward the substrate 11 to be coated in the bottom part of the deposition chamber 10 by the help of gravity. So the main movement of the aerosol is caused by the gravity outside the vicinity of the atomizers. Aerosol mainly spreads out in the deposition chamber 10 toward the substrate 11 to be coated which is in the bottom part of the chamber 10 but some of the aerosol may also spread on the upper part of the deposition chamber 10 so preferably a suction or similar arrangement is arranged in the upper part of the chamber 10 to collect the excess of the aerosol so as to recycle the precursor material to be used again in the coating process. Another embodiment of the invention is to arrange suction or other similar arrangement to remove excess of the aerosol in the bottom part of the deposition chamber. The precursor liquid that is deposited as part of the aerosol on the bottom of the deposition chamber or on the walls is transferred by gravity on the bottom of the deposition chamber wherefrom it can be removed as a liquid. It is very advantageous to collect said liquid because the precursors may be expensive. Excess aerosol can be collected also in the bottom part of the chamber 10 if the substrate 11 is arranged such that it does not cover all of the bottom part of the chamber 10 and that some of the aerosol moves beyond the substrate 11. The location that is shown in more detail in FIG. 2 is presented with letter A in FIG. 1.

Figure 2:
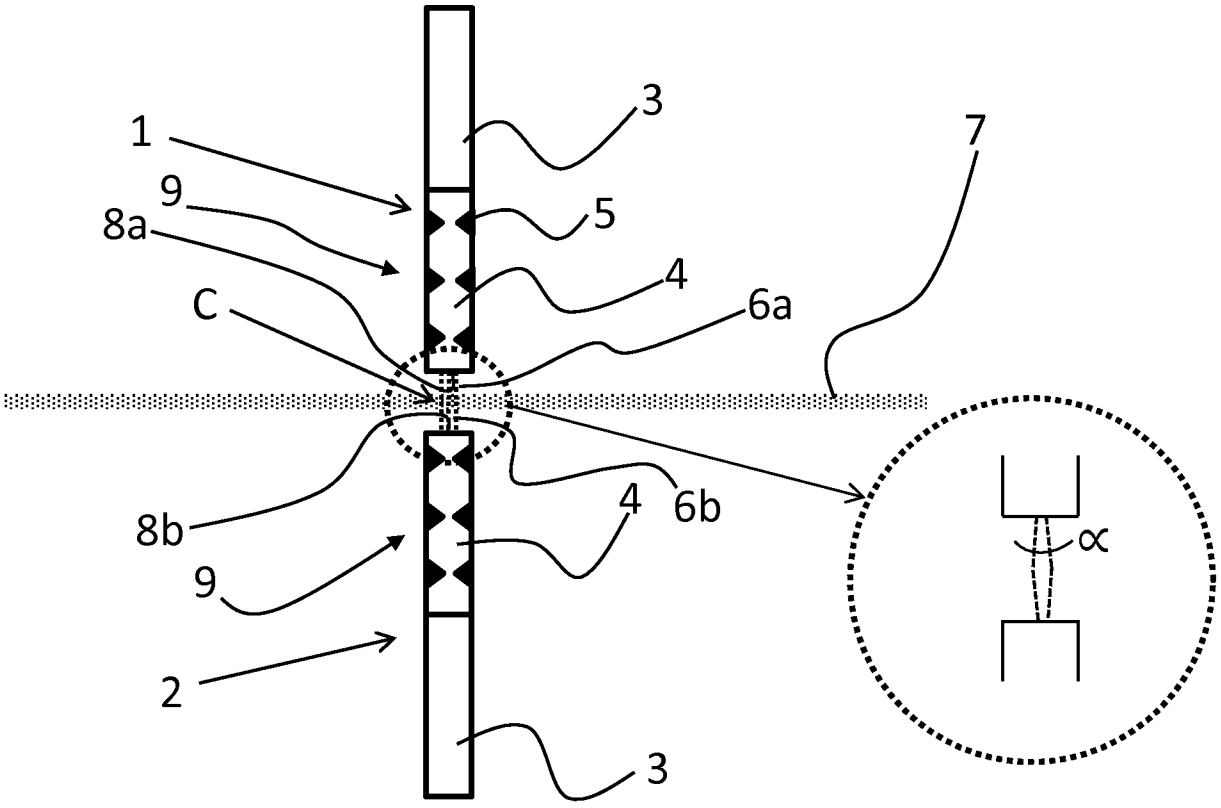
FIG. 2 shows a detail of FIG. 1.

In FIG. 2 a detail of FIG. 1 is shown in which the first and the second atomizer 1, 2 are arranged coaxially in a vertical direction such that the discharge openings 8*a*, 8*b* of the atomizers 1, 2 are arranged coaxially along an imaginary vertical line in a deposition chamber. The atomizer 1, 2 is a gas-dispersing atomizer for atomizing liquid into aerosol by means of gas at the atomizing head 3 of the atomizer 1, 2 and comprises at least one liquid conduit for feeding at least one liquid to be atomized into the atomizing head 3 and at least one gas conduit for feeding at least one gas into the atomizing head 3 for atomizing the liquid (these are not shown in figure). The apparatus may be accomplished in a manner allowing the same or a different liquid to be fed to two or more atomizers 1, 2. In other words, the same or a different liquid may be fed to the atomizers 1, 2 of each atomizer pair, when desired.

The atomizers 1, 2 further comprise a focusing part 9 arranged to restrain the atomized aerosol jet for providing a punctual aerosol jet, said focusing part extending directly from the atomizing head 3 and having the discharge opening 8*a*, 8*b*. According to one embodiment of the invention the focusing part 9 is a choked flow part 4 in which one or more flow restraints 5 are arranged to change the hydrodynamic properties of the aerosol jet being discharged from the atomizing head 3 into the focusing part 9 which is the choked flow part 4 in a manner reducing the average drop size of the aerosol jet, the choked flow part 4 extending directly from the atomizing head 3. The choked flow part 4 extends from the atomizing head 3 directly such that when the aerosol jet 6*a*, 6*b* is discharged from the atomizing head 3 to the choked flow part 4 it instantly arrives to the choked flow part 4 after leaving the atomizing head 3. The FIG. 2 shows an embodiment in which both of the atomizers 1, 2 comprise a choked flow part 4 although it is possible that only one of the atomizers comprise the choked flow part 4 or none of the atomizers 1, 2 comprise it. In the choked flow part 4 one or more flow restraints 5 are arranged such that they are placed in succession, adjacently or in a corresponding manner with respect to each other. So an average drop size of the aerosol jet is reduced by arranging a choked flow part 4 to at least one of the atomizers 1, 2 such that before being discharged through the discharge opening 8*a*, 8*b* the atomized liquid is arranged to go through said choked flow part 4. A detail in FIG. 2 shows a total opening angle $\alpha$ of the aerosol jet discharged from the atomizing head 3. The total opening angle $\alpha$ is less than 10°.

Figures 3A, 3B, 3C:
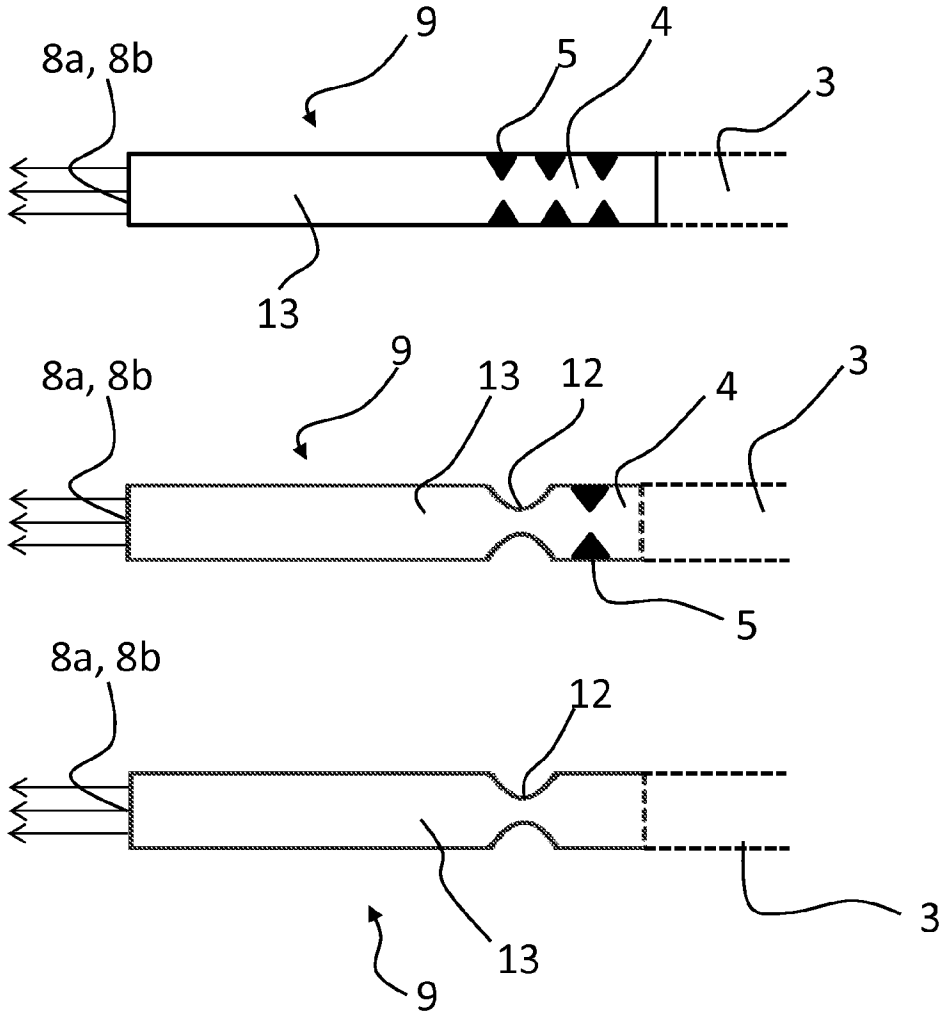
FIG. 3*a* shows one embodiment of the focusing part according to the invention.
FIG. 3*b* shows another embodiment of the focusing part according to the invention.
FIG. 3*c* shows yet another embodiment of the focusing part according to the invention.

FIG. 3*a* shows an embodiment of the focusing part 9 according to the invention in which the focusing part 9 is a choked flow part 4 which comprises a levelling area 13 between the discharge opening 8*a*, 8*b* and the nearest flow restraint to the discharge opening 8*a*, 8*b* for levelling the punctual aerosol jet. Although the focusing part 9 has a minimum length of at least ten times the inner diameter of the focusing part a preferable length for the levelling area 13 is at least ten times the inner diameter of the focusing part 9 in the levelling area 13. This means that in this embodiment the choked flow part 4 may be short or at least shorter than the levelling area 13 or the length of the total focusing part 9 is more. The preferable length of the levelling area 13 applies also to other embodiments of the focusing part 9.

FIG. 3*b* shows a focusing part 9 according to another embodiment of the invention in which the focusing part 9 is substantially a tubular, round part after the atomizing head 3 in the direction of the aerosol flow. The length of the focusing part 9 is at least 10×, preferably 15× the inner diameter of the focusing part 9. In the embodiment of the invention shown in FIG. 3*b* the focusing part 9 comprises a choked flow part 4 in which one or more flow restraints 5 are arranged to change the hydrodynamic properties of the aerosol jet being discharged from the atomizing head 3 into the choked flow part 4 in a manner reducing the average drop size of the aerosol jet. The choked flow part 4 comprises after the flow restraints 5 in the direction of the aerosol flow a tubular levelling area 13 between the discharge opening 8*a*, 8*b* and the nearest flow restraint to the discharge opening 8*a*, 8*b* for levelling the punctual aerosol jet, the levelling area 13 comprising a section 12 having a smaller inner diameter than the inner diameter of the rest of the levelling area 13. The section having a smaller inner diameter than the inner diameter of the rest of the levelling area 13 is preferably arranged nearer to the flow restraints 5 than to the discharge opening 8*a*, 8*b*.

FIG. 3*c* shows another embodiment of the focusing part 9 according to the invention in which the focusing part 9 is a tubular part comprising a section 12 for restraining the atomized aerosol jet. The section 12 has a smaller inner diameter than the inner diameter of the rest of the tubular part. The tubular part comprises after the section 12 for restraining the atomized aerosol jet a levelling area 13 before the aerosol jet is discharged through the discharge opening 8*a*, 8*b*. In the method of the present invention for producing aerosol, one or more liquids are atomized into two or more aerosol jets 6*a*, 6*b*. The aerosol jet 6*a*, 6*b* itself may constitute aerosol. In accordance with the invention, at least two aerosol jets 6*a*, 6*b* are directed substantially directly towards each other in a manner making the aerosol jets 6*a*, 6*b* collide directly into each other. Two aerosol jets 6*a*, 6*b* are preferably directed substantially coaxially towards one another in a manner making the aerosol jets 6*a*, 6*b* collide substantially directly against one another. Coaxial means that the aerosol jets 6*a*, 6*b* move substantially coaxially directly towards one another, and thus the angle of collision between the aerosol jets 6*a*, 6*b* is about 180 degrees.

The first and the second atomizer 1, 2 are arranged in a vertical direction such that the aerosol formed from the collision of the aerosol jets 6*a*, 6*b* forms a horizontal aerosol plane when escaping from the collision point C. The substrate 11 to be coated is arranged in the deposition chamber 10 such that the surface to be coated is parallel to the aerosol plane which is substantially horizontal such that the substrate 11 is coated by said aerosol plane falling under gravity.

It will be obvious to a person skilled in the art that, as the technology advances, the inventive concept can be implemented in various ways. The invention and its embodiments are not limited to the examples described above but may vary within the scope of the claims.

The invention claimed is:

1. An apparatus for producing aerosol, the apparatus comprising:

a first atomizer for producing a first aerosol jet and a second atomizer for producing a second aerosol jet, said aerosol jets are produced from one or more liquid precursors and discharged from a respective atomizer through a discharge opening in the atomizer, wherein each atomizer comprises an atomizing head in which the liquid is atomized into an atomized aerosol jet, each atomizing head is directly connected to a tubular focusing part arranged to restrain the atomized aerosol jet for providing a punctual aerosol jet, wherein said tubular focusing part is formed of a choked flow part in which one or more flow restraints project from the inner surface of the tubular focusing part to change the hydrodynamic properties of the atomized aerosol jet discharged from the atomizing head into the choked flow part in a manner that reduces the average drop size of the aerosol jet, and a levelling part without projecting flow restraints on the inner surface of the tubular focusing part, and said levelling part has a length of at least ten times the inner diameter of the focusing part in the levelling part, said first and second atomizer form an atomizer pair such that the atomizers are aligned towards each other for colliding the aerosol jets to each other, the first and the second atomizer are arranged in a substantially vertical direction such that the aerosol formed in the collection of the aerosol jets forms a substantially horizontal aerosol plane when escaping from the collision point.

2. The apparatus according to claim 1, wherein the focusing part has means for restraining the atomized aerosol jet such that a total opening angle of the punctual aerosol jet is less than 10°.

3. The apparatus according to claim 1, wherein distance between the discharge openings in the opposing atomizers is in a range of 0.5-15 mm.

4. The apparatus according to claim 1, wherein distance between the discharge openings in the opposing atomizers is in a range of 1-10 mm.

5. The apparatus according to claim 1, wherein one or more flow restraints are arranged in the choked flow part such that they are placed in succession, adjacently or in a corresponding manner with respect to each other.

6. The apparatus according to claim 1, wherein the first and the second atomizer are arranged coaxially.

7. The apparatus according to claim 1, wherein the first and the second atomizer are arranged in the vertical direction such that the discharge openings of the atomizers are arranged substantially coaxially in a deposition chamber.

8. The apparatus according to claim 1, wherein the atomizer is a gas-dispersing atomizer for atomizing liquid into aerosol by means of gas at the atomizing head of the atomizer and comprises at least one liquid conduit for feeding at least one liquid to be atomized into the atomizing head and at least one gas conduit for feeding at least one gas into the atomizing head for atomizing the liquid.

9. The apparatus according to claim 1, wherein the first and the second atomizer are in a deposition chamber.

10. The apparatus according to claim 7, wherein the first and the second atomizer are in a central region of said deposition chamber such that there is free space around said first and said second atomizer.

11. A method for producing aerosol, said method comprising the steps of:

arranging a first atomizer and a second atomizer opposite to each other such that a discharge opening of the first atomizer is opposite to a discharge opening of the second atomizer, said first and second atomizer comprising an atomizing head for atomizing an aerosol jet, atomizing at least one liquid precursor into a first atomized aerosol jet in the first atomizing head and into a second atomized aerosol jet in the second atomizing head, restraining the first atomized aerosol jet and the second atomized aerosol jet respectively into a first punctual aerosol jet and a second punctual aerosol jet in a tubular focusing part that extends directly from the atomizing head, the focusing part being formed of a choked flow part in which one or more flow restraints project from the inner surface of the tubular focusing part to change the hydrodynamic properties of the atomized aerosol jet discharged from the atomizing head into the choked flow part in a manner that reduces the average drop size of the aerosol jet, and a levelling part without projecting flow restraints on the inner surface of the tubular focusing part, wherein said levelling part has a length of at least ten times the inner diameter of the focusing part in the levelling part, discharging said punctual aerosol jets from the discharge openings of the atomizers such that the punctual aerosol jets coming out from the discharge openings are directed substantially directly towards each other in such a manner that the first and the second punctual aerosol jets collide directly into each other in a collision point, bringing said at least one liquid into the first and the second atomizer in such a pressure that the first and the second punctual aerosol jets when colliding each other in the collision point form aerosol which escapes horizontally from the collision point.

12. The method according to claim 11, wherein the method further comprising the step of arranging the first and the second atomizer in a substantially vertical direction such that the aerosol formed in the collision of the aerosol jets forms a substantially horizontal aerosol plane when escaping from the collision point.

13. The method according to claim 12, wherein the method further comprising the step of arranging a substrate to be coated parallel to the substantially horizontal aerosol plane such that the substrate is coated by said aerosol plane falling under gravity.

14. The method according to claim 11, wherein the method further comprises a step of arranging the atomizers and the substrate to be coated in the same deposition chamber.

15. A focusing part for an atomizer, which said atomizer comprises an atomizing head for producing an atomized aerosol jet from one or more liquid precursors, wherein the focusing part:

is a tube formed of a choked flow part in which one or more flow restraints project from the inner surface of the tubular focusing part to change the hydrodynamic properties of the atomized aerosol jet discharged from the atomizing head into the choked flow part in a manner that reduces the average drop size of the aerosol jet, and a levelling part without projecting flow restraints on the inner surface of the tubular focusing part, wherein said levelling part has a length of at least ten times the inner diameter of the focusing part in the levelling part, is arranged to extend directly from the atomizing head and is arranged to restrain the atomized aerosol jet for providing a punctual aerosol jet, comprises a discharge opening for discharging the punctual aerosol jet.

16. The focusing part according to claim 15, wherein the levelling part comprises a section having a smaller inner diameter than the inner diameter of the rest of the levelling part.

* * * * *